US011624144B2

(12) United States Patent
Choi et al.

(10) Patent No.: US 11,624,144 B2
(45) Date of Patent: Apr. 11, 2023

(54) GARMENT PROCESSING DEVICE

(71) Applicant: LG Electronics Inc., Seoul (KR)

(72) Inventors: Jeongryeol Choi, Seoul (KR); Minhyoung Lee, Seoul (KR); Seonghui Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 12 days.

(21) Appl. No.: 17/362,323

(22) Filed: Jun. 29, 2021

(65) Prior Publication Data

US 2021/0324567 A1 Oct. 21, 2021

Related U.S. Application Data

(63) Continuation of application No. 16/312,926, filed as application No. PCT/KR2017/006659 on Jun. 23, 2017, now Pat. No. 11,085,142.

(51) Int. Cl.
*D06F 39/12* (2006.01)
*D06F 35/00* (2006.01)
(Continued)

(52) U.S. Cl.
CPC ..... *D06F 39/12* (2013.01); *D06F 35/00* (2013.01); *D06F 58/20* (2013.01); *D06F 73/02* (2013.01); *D06F 58/10* (2013.01)

(58) Field of Classification Search
CPC ..... D06F 39/12; D06F 39/125; D06F 35/00; D06F 58/10; D06F 58/20; D06F 73/02;
(Continued)

(56) References Cited

U.S. PATENT DOCUMENTS 154,580 A * 9/1874 Buckner, Jr. ..... E06B 3/9845 403/294
1,130,807 A * 3/1915 Fingerhut ..... B64G 1/645 403/321
(Continued)

FOREIGN PATENT DOCUMENTS

CN 102002838 4/2011
CN 103103716 5/2013
(Continued)

OTHER PUBLICATIONS

CN Office Action in Chinese Application No. 201780052070.3, dated Jul. 3, 2020, 15 pages (with English translation).
(Continued)

*Primary Examiner* — Ismael Izaguirre
(74) *Attorney, Agent, or Firm* — Fish & Richardson P.C.

(57) ABSTRACT

A clothes treatment apparatus includes a first case, a second case, a width-direction bracket for coupling at least one of front walls or rear walls of the first case and the second case to each other in a width direction, a depth-direction bracket for coupling at least one of upper walls or lower walls of the first case and the second case to each other in a depth direction, and a height-direction bracket for coupling at least one of the front walls or the rear walls of the first case and the second case to each other in a height direction. At least two of the width-direction bracket, the depth-direction bracket, or the height-direction bracket are configured to fix at least two surfaces of the first case and the second case.

20 Claims, 14 Drawing Sheets

(51) Int. Cl.

| | |
|---|---|
| ***D06F 58/20*** | (2006.01) |
| ***D06F 73/02*** | (2006.01) |
| *D06F 58/10* | (2006.01) |
| *D06F 73/00* | (2006.01) |

(58) Field of Classification Search

CPC .. E04C 2/38; E04F 19/00; E04F 19/02; E04F 19/022; E04F 19/06; E04F 19/062; E04F 19/063; F16B 12/00; F16B 12/02; F16B 12/10; F16B 12/20; F16B 12/22; F16B 12/24; F16B 9/00; F16B 1/00; F16B 2/24; F16B 3/00; F16B 3/04; F16B 5/00; F16B 5/002; F16B 5/0024; F16B 5/0052; F16B 5/0072; F16B 5/0068; F16B 2012/046; F16J 15/02; F16J 15/08; A47B 47/00; A47B 47/0025; A47B 53/00; A47B 53/02; A47B 87/002; A47B 87/005; A47B 87/008; A47B 87/007; A47B 2230/07; A47B 2230/11; A47B 2230/12; A47B 2230/14; A47B 2230/15; A47B 2230/16; A47B 96/00; A47B 96/06; A47B 2220/0036

See application file for complete search history.

(56) References Cited

U.S. PATENT DOCUMENTS

| | | | | |
|---|---|---|---|---|
| 2,824,775 | A * | 2/1958 | Sitler | A47B 57/50 312/111 |
| 3,132,883 | A * | 5/1964 | Tantlinger | B61B 1/005 280/8 |
| 3,703,870 | A * | 11/1972 | Walton | B65D 88/129 108/51.11 |
| 4,821,535 | A | 4/1989 | Wassilak et al. | |
| 5,357,727 | A * | 10/1994 | Duckworth | E04B 1/681 52/573.1 |
| 5,486,041 | A * | 1/1996 | Sykes | F16B 12/46 312/263 |
| 6,082,841 | A | 7/2000 | Smith et al. | |
| 7,140,206 | B2 | 11/2006 | Braun et al. | |
| 7,587,917 | B2 | 9/2009 | Gilboe et al. | |
| 7,617,702 | B2 * | 11/2009 | Sunshine | D06F 43/08 68/3 R |
| 8,579,389 | B1 * | 11/2013 | Kuo | A47B 87/008 312/111 |
| 11,085,142 | B2 * | 8/2021 | Choi | D06F 39/12 |
| 2007/0119216 | A1 | 5/2007 | Jeong et al. | |
| 2009/0151385 | A1 | 6/2009 | Hägele et al. | |
| 2010/0018259 | A1 | 1/2010 | Jeong et al. | |

FOREIGN PATENT DOCUMENTS

| | | | | |
|---|---|---|---|---|
| CN | 105544143 | | 5/2016 | |
| DE | 102005026134 | | 12/2006 | |
| EP | 2290143 | | 3/2011 | |
| JP | S53049408 | | 4/1953 | |
| JP | 37017392 | | 7/1962 | |
| JP | S54152724 | | 10/1979 | |
| JP | S5836840 | | 9/1981 | |
| JP | 62160822 | | 7/1987 | |
| JP | S62160822 | | 7/1987 | |
| JP | 05034936 | | 5/1993 | |
| JP | H08019439 | | 1/1996 | |
| JP | 2002-232168 | | 8/2002 | |
| JP | 2013103136 | | 5/2013 | |
| JP | 2019520147 | | 7/2019 | |
| KR | 20070078278 | | 7/2007 | |
| KR | 200437132 | | 11/2007 | |
| KR | 20080065754 | | 7/2008 | |
| KR | 20090057795 | | 6/2009 | |
| KR | 101597108 | | 2/2016 | |
| WO | WO-2009052656 | A1 * | 4/2009 | A47B 13/021 |
| WO | WO2011108860 | | 9/2011 | |

OTHER PUBLICATIONS

EP Supplementary Search Report in European Appln. No. 17815753, dated Mar. 13, 2020, 8 pages.

JP Office Action in Japanese Appln. No. 2018-567283, dated Oct. 26, 2020, 11 pages (with English translation).

JP Office Action in Japanese Appln. No. 2018-567283, dated Feb. 25, 2020, 11 pages (with English translation).

PCT International Search Report and Written Opinion in International Appln. No. PCT/KR2017/006659, dated Oct. 26, 2017, 13 pages (with English translation).

Office Action in Japanese Appln. No. 2021-109965, dated Jun. 14, 2022, 8 pages (with English translation).

Office Action in Chinese Appln. No. 202110663290.8, dated Nov. 28, 2022, 10 pages (with English translation).

* cited by examiner

GARMENT PROCESSING DEVICE

CROSS-REFERENCE TO RELATED APPLICATIONS

This application is a continuation of U.S. application Ser. No. 16/312,926, filed on Dec. 21, 2018, which is a National Stage application under 35 U.S.C. § 371 of International Application No. PCT/KR2017/006659, filed on Jun. 23, 2017, which claims the benefit of Korean Application No. 10-2016-0079504, filed on Jun. 24, 2016. The disclosures of the prior applications are incorporated by reference in their entirety.

TECHNICAL FIELD

The present invention relates to a clothes treatment apparatus, and more particularly to a clothes treatment apparatus including two doors.

BACKGROUND

Clothes treatment apparatuses are apparatuses that treat clothes, e.g. wash and dry clothes and remove wrinkles from clothes, at home or at laundromats. For example, clothes treatment apparatuses may be classified into a washer for washing clothes, a dryer for drying clothes, a washer/dryer having both a washing function and a drying function, a refresher for refreshing clothes, and a steamer for removing unnecessary wrinkles from clothes.

The refresher is an apparatus that keep clothes comfortable and fresh. The refresher functions to dry clothes, to supply fragrance to clothes, to prevent the occurrence of static electricity in clothes, or to remove wrinkles from clothes. The steamer is an apparatus that simply supplies steam to clothes in order to remove wrinkles from the clothes. Unlike a general iron, the steamer delicately removes wrinkles from the clothes without directly applying heat to the clothes.

A clothes treatment apparatus having both the functions of a refresher and a steamer may remove wrinkles from clothes received therein, and may deodorize the clothes, using steam and hot air. As these functions are used, the clothes received in the clothes treatment apparatus may be deodorized, or wrinkles may be removed from the clothes, whereby an ironing effect may be achieved.

SUMMARY

It is an object of the present invention to provide a structure that is capable of effectively coupling two independent clothes treatment units to each other.

The objects of the present invention are not limited to the above-mentioned object, and other objects that have not been mentioned above will become evident to those skilled in the art from the following description.

In accordance with an aspect of the present invention, the above and other objects can be accomplished by the provision of a clothes treatment apparatus including a first clothes treatment including a first case, a second clothes treatment including a second case, and a union assembly for fixing at least two surfaces of the first case and the second case.

The union assembly may include a width-direction bracket for coupling the first case and the second case to each other in a width direction, a depth-direction bracket for coupling the first case and the second case to each other in a depth direction, and a height-direction bracket for coupling the first case and the second case to each other in a height direction, and at least two of the width-direction bracket, the depth-direction bracket, or the height-direction bracket may fix the at least two surfaces of the first case and the second case.

The clothes treatment apparatus may further include a gap member disposed between the first case and the second case for spacing the first case and the second case apart from each other by a predetermined distance.

Each of the first case and the second case may be provided with an installation recess, into which at least one of the width-direction bracket, the depth-direction bracket, or the height-direction bracket is inserted, and the at least one of the width-direction bracket, the depth-direction bracket, or the height-direction bracket may be inserted into the installation recess and may then be fixed using a fastening member.

The clothes treatment apparatus may further include a bracket cover coupled to the installation recess for covering the installation recess.

In accordance with another aspect of the present invention, there is provided a clothes treatment apparatus including a first case including an upper wall, a lower wall, a left wall, a right wall, a rear wall, and a front wall, a second case including an upper wall, a lower wall, a left wall, a right wall, a rear wall, and a front wall, a width-direction bracket for coupling at least one of the front walls or the rear walls of the first case and the second case to each other in a width direction, a depth-direction bracket for coupling at least one of the upper walls or the lower walls of the first case and the second case to each other in a depth direction, and a height-direction bracket for coupling at least one of the front walls or the rear walls of the first case and the second case to each other in a height direction.

The width-direction bracket may couple the front walls to each other, the depth-direction bracket may couple the upper walls to each other, and the height-direction bracket may couple the rear walls to each other.

The clothes treatment apparatus may further include a gap member disposed between the first case and the second case for spacing the first case and the second case apart from each other by a predetermined distance.

The clothes treatment apparatus may further include width-direction installation recesses formed in the front wall of the first case and in the front wall of the second case, and the width-direction bracket may be inserted into and installed in the width-direction installation recesses.

The clothes treatment apparatus may further include a bracket cover coupled to the width-direction installation recesses for covering the width-direction installation recesses to hide the width-direction installation recesses.

The clothes treatment apparatus may further include an upward-downward separation plate for partitioning the interior of the first case into a treatment chamber and a cycle chamber, and the height-direction bracket may be disposed at the rear of the upward-downward separation plate.

The clothes treatment apparatus may further include legs disposed at lower sides of the first case and the second case for supporting loads, and the width-direction bracket may be disposed above the legs.

The clothes treatment apparatus may further include an upward-downward separation plate for partitioning the interior of the first case into a treatment chamber and a cycle chamber and an upward-downward separation plate for partitioning the interior of the second case into a treatment chamber and a cycle chamber, and the width-direction bracket may be disposed in front of the cycle chamber of the first case and the cycle chamber of the second case.

The first case may further include a first decoration frame constituting a portion of the front wall, the second case may further include a second decoration frame constituting a portion of the front wall, and the width-direction installation recesses may be formed in the first decoration frame and in the second decoration frame.

The first decoration frame may include a hinge installation recess in which a door hinge of the first case is installed and the width-direction installation recess in which the width-direction bracket is installed, the second decoration frame may include a hinge installation recess in which a door hinge of the second case is installed and the width-direction installation recess in which the width-direction bracket is installed, the hinge installation recess of the first case and the hinge installation recess of the second case may be disposed outside, and the width-direction installation recess of the first case and the width-direction installation recess of the second case may be disposed inside.

The first decoration frame may include a hinge installation recess in which a door hinge of the first case is installed and the width-direction installation recess in which the width-direction bracket is installed, and the hinge installation recess and the width-direction installation recess of the first decoration frame may be disposed symmetrically in a vertical direction.

The details of other embodiments are included in the following description and the accompanying drawings.

The clothes treatment apparatus according to the present invention has one or more of the following effects.

First, at least two of the width-direction bracket, the depth-direction bracket, or the height-direction bracket fix at least two surfaces of the first case and the second case, whereby it is possible to improve the rigidity of the clothes treatment apparatus against external force and to maximally prevent vibration generated in one of the cases from being transmitted to the other case.

Second, the width-direction bracket is installed in front of the cycle chamber, in which vibration is mainly generated, and the height-direction bracket is installed at the rear of the cycle chamber, whereby it is possible to effectively prevent the generation of vibration.

Third, the width-direction bracket is installed at the first case and the second case in the width direction, the depth-direction bracket is installed at the first case and the second case in the depth direction, and the height-direction bracket is installed at the first case and the second case in the height direction, whereby it is possible to fix the first case and the second case in the width direction, in the depth direction, and in the height direction, and therefore it is possible to effectively support or withstand vibration or external force applied to the cases in all directions.

Fourth, the width-direction installation recesses are formed in the front walls of the first case and the second case, the width-direction bracket is installed in the width-direction installation recesses, and the bracket cover is mounted to the width-direction installation recesses, whereby it is possible to prevent the width-direction bracket from being exposed to a user.

Fifth, the gap member spaces the first case and the second case apart from each other by a predetermined distance, whereby it is possible to prevent the doors from interfering with each other when the doors are opened.

Sixth, the first case and the second case are spaced apart from each other by the gap member, whereby it is possible to maximally prevent vibration generated in one of the cases from being transmitted to the other case.

It should be noted that effects of the present invention are not limited to the effects of the present invention as mentioned above, and other unmentioned effects of the present invention will be clearly understood by those skilled in the art from the following claims.

DETAILED DESCRIPTION

Advantages and features of the present invention and a method of achieving the same will be more clearly understood from embodiments described below with reference to the accompanying drawings. However, the present invention is not limited to the following embodiments but may be implemented in various different forms. The embodiments are provided merely to complete disclosure of the present invention and to fully provide a person having ordinary skill in the art to which the present invention pertains with the category of the invention. The invention is defined only by the category of the claims. Wherever possible, the same reference numbers will be used throughout the specification to refer to the same or like elements.

Hereinafter, embodiments of a clothes treatment apparatus according to the present invention will be described with reference to the accompanying drawings.

Figure 1:
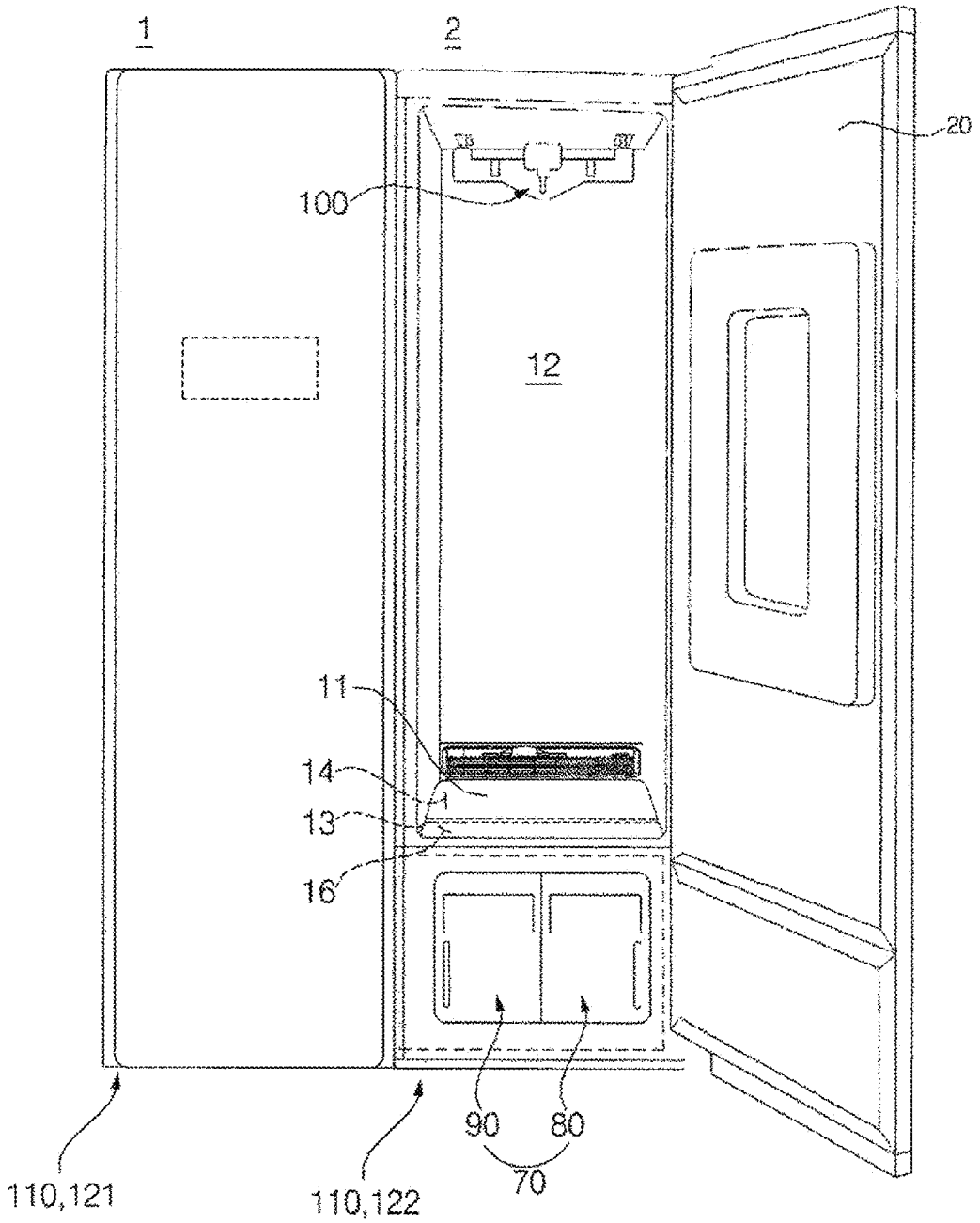
FIG. 1 is a perspective view of a clothes treatment apparatus according to an embodiment of the present invention.
Figure 2:
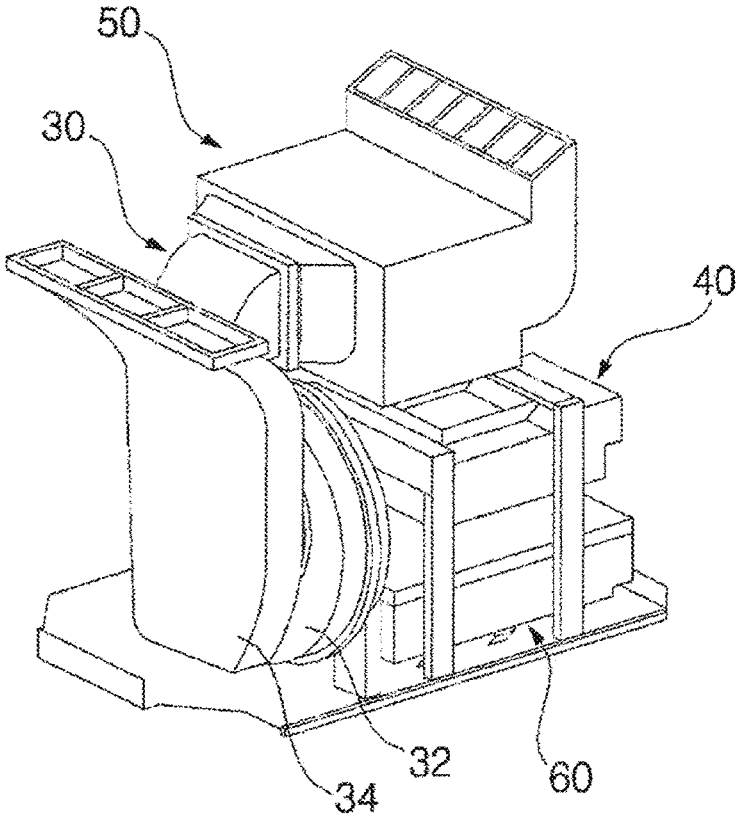
FIG. 2 is a partial perspective view of the clothes treatment apparatus shown in FIG. 1.
Figure 3:
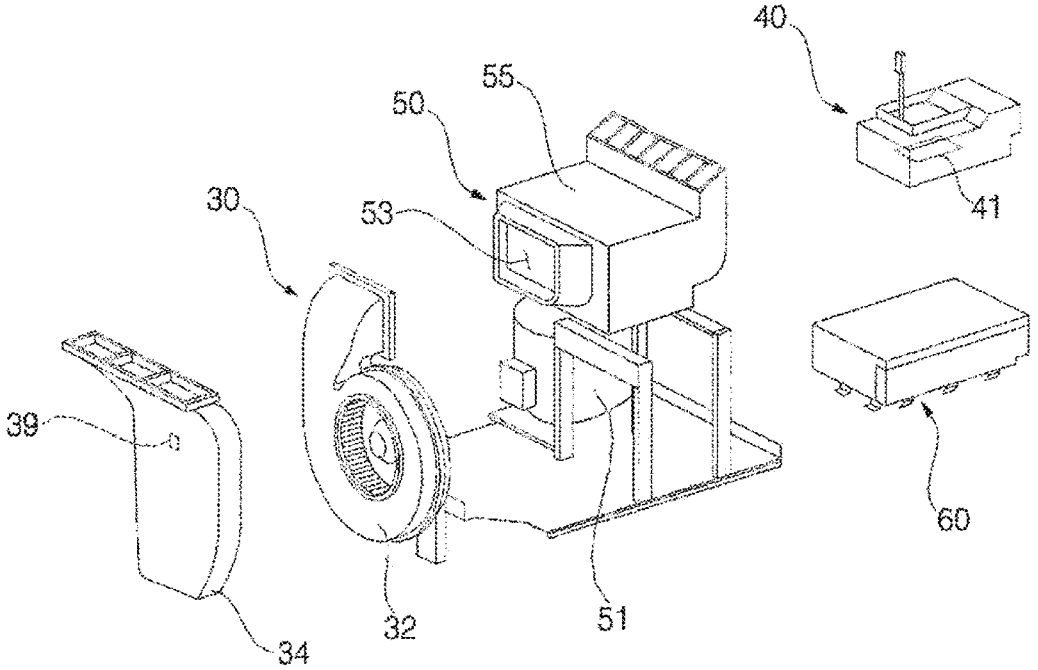
FIG. 3 is a partial exploded perspective view of the clothes treatment apparatus shown in FIG. 1.
Figure 4:
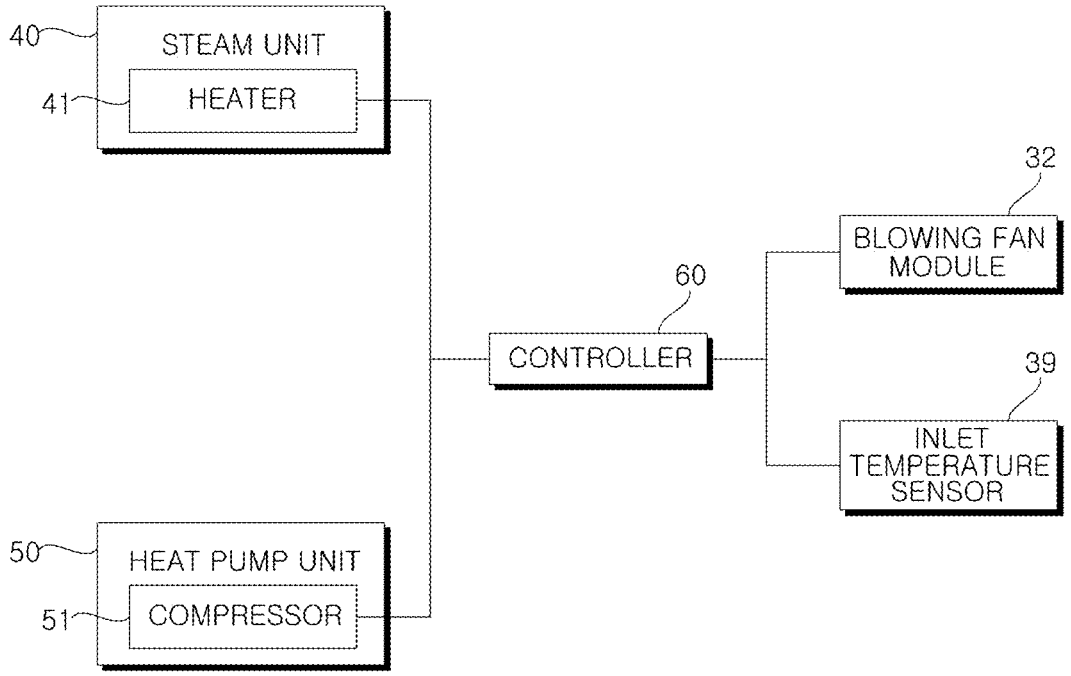
FIG. 4 is a block diagram of the clothes treatment apparatus shown in FIG. 1.

FIG. 1 is a perspective view of a clothes treatment apparatus according to an embodiment of the present invention, FIG. 2 is a partial perspective view of the clothes treatment apparatus shown in FIG. 1, FIG. 3 is a partial exploded perspective view of the clothes treatment apparatus shown in FIG. 1, and FIG. 4 is a block diagram of the clothes treatment apparatus shown in FIG. 1.

The clothes treatment apparatus according to the embodiment of the present invention may include a plurality of clothes treatment units 1 and 2. The clothes treatment units 1 and 2 may be operated independently. Each of the clothes treatment units 1 and 2 includes a case 110, a door 20, a steam unit 40, a blowing unit 30, a heat pump unit 50, a moving hanger 100, and a controller 60.

The doors 20 are provided at the respective cases 110. The doors 20 are opened in different directions. That is, the door 20 provided at the left case 110 is opened and closed to the left, and the door 20 provided at the right case 110 is opened and closed to the right.

The left clothes treatment apparatus is defined as a first clothes treatment unit 1, and the right clothes treatment apparatus is defined as a second clothes treatment unit 2.

The first clothes treatment unit 1 and the second clothes treatment unit 2 may be operated independently. For example, the controller 60 of the first clothes treatment unit and the controller 60 of the second clothes treatment unit 2 may execute courses independently.

In particular, the controller of the first clothes treatment unit 1 may execute a course for treating general clothes, and the second clothes treatment unit 2 may execute a course for treating special clothes.

For example, the first clothes treatment unit 1 may execute a course for treating general clothes, such as woolens, knits, formal dresses, and coats, and the second clothes treatment unit 2 may execute a course for treating functional clothes, uniforms, school uniforms, jeans, and padded clothes.

Since the first clothes treatment unit 1 and the second clothes treatment unit 2 have the same construction, each unit will be simply referred to as a clothes treatment unit in the following description.

The clothes treatment unit according to this embodiment includes a case 110 having therein a treatment chamber 12 and a cycle chamber 14, a door 20 mounted to the case 110 for opening and closing the treatment chamber 12, a steam unit 40 for supplying steam to the treatment chamber 12, a blowing unit 30 for circulating air in the treatment chamber 12, a heat pump unit 50 for air-conditioning air in the treatment chamber 12, a moving hanger 100 disposed in the treatment chamber 12 for holding and vibrating clothes, and a controller 60 for controlling the steam unit 40, the blowing unit 30, the heat pump unit 50, or the moving hanger 100.

The case 110 is provided therein with an upward-downward separation plate 11 for partitioning the interior thereof into upper and lower parts. The treatment chamber 12 is defined on the upper side of the upward-downward separation plate 11, and the cycle chamber 14 is defined on the lower side of the upward-downward separation plate 11. In addition, a forward-rearward separation plate 13 is provided in order to partition the lower side of the treatment chamber 12. The cycle chamber 14 is also defined by the forward-rearward separation plate 13.

In this embodiment, the cycle chamber 14 is defined between the case 110 and the forward-rearward separation plate 13. A water supply tank 80 and a drainage tank 90 are disposed in front of the forward-rearward separation plate.

A tank installation space 16, in which the water supply tank 80 and a drainage tank 90 are separably installed, is defined in front of the forward-rearward separation plate.

In this embodiment, the door 20 simultaneously opens and closes the treatment chamber 12 and the tank installation space 16. Unlike this embodiment, the door 20 may open and close only the treatment chamber 12.

Clothes are held in the treatment chamber 12, in which wrinkles are removed from the clothes or the clothes are deodorized through steam or air circulation or drying.

In the cycle chamber 14 are disposed the blowing unit 30, which suctions and circulates air in the treatment chamber 12, the steam unit 40, which supplies steam to the treatment chamber 12, the heat pump unit 50, which supplies heated air to the treatment chamber 12, and the controller 60, which controls the units 30, 40, and 60.

The blowing unit 30 suctions air in the treatment chamber 12 under the control of the controller 60. The air suctioned by the blowing unit 30 is discharged to the heat pump unit 50.

The blowing unit 30 includes a blowing fan module 32 for suctioning air in the treatment chamber 12 and discharging the suctioned air to the heat pump unit 50 through the rotation of a fan and an inlet duct 34 installed on the suction side of the blowing fan module 32 for guiding the air in the treatment chamber 12 to the blowing fan module 32.

One side of the inlet duct 34 is connected to the treatment chamber 12, and the other side of the inlet duct 34 is connected to the blowing fan module 32. In the inlet duct 34 is provided an inlet temperature sensor 39 for measuring the temperature of air flowing in the inlet duct 34, which will be referred to as an inlet temperature. The inlet temperature sensor 39 measures the temperature of the air suctioned into the inlet duct 34 from the treatment chamber 12, i.e. the inlet temperature, and transmits the measured temperature to the controller 60.

One side of the blowing fan module 32 is connected to the inlet duct 34, and the other side of the blowing fan module 32 is connected to the heat pump unit 50. The blowing fan module 32 is a single module that is constituted by a sirocco fan, a duct, and a motor.

The steam unit 40 supplies steam to the treatment chamber 12 under the control of the controller 60. When power is supplied thereto, the stream unit 40 generates heat, by which water supplied from the water supply tank 80 is heated in order to generate steam.

The steam generated by the steam unit 40 is discharged to the treatment chamber 12. In this embodiment, the steam generated by the steam unit 40 flows to the treatment chamber 12 via a flow channel defined in the heat pump unit 50. The steam unit 40 may be connected to the heat pump unit 50.

Unlike this embodiment, a flow channel defined in the steam unit 40 and the flow channel defined in the heat pump unit 50 may be separately provided.

The steam unit 40 includes a heater 41 for heating water. Under the control of the controller 60, the steam unit 40 preheats the heater 41, and then generates steam.

Under the control of the controller 60, the heat pump unit 50 heats the air suctioned by the blowing unit 30 and discharges the heated air into the treatment chamber 12. The heat pump unit 50 supplies the heated air to the treatment chamber 12.

The heat pump unit 50 is constituted by a refrigeration cycle including a compressor 51, a condenser 53, an evaporator (not shown), and an expansion valve (not shown). The heat pump unit 50 includes a heat pump housing 55, in which the condenser 53 is disposed. The heat pump housing 55 includes a heat pump flow channel for guiding air to the treatment chamber 12.

The heat pump flow channel is defined in the heat pump housing 55.

One side of the heat pump housing 55 is connected to the blowing fan module 32, and the other side of the heat pump housing 55 is connected to the treatment chamber 12.

The compressor 51 compresses a refrigerant into a high-temperature, high-pressure state. The refrigerant compressed by the compressor 51 moves to the condenser 53, in which the refrigerant exchanges heat with air. While passing through the condenser 53, the refrigerant is condensed, is expanded by the expansion valve, and is evaporated by the evaporator.

The condenser 53 exchanges heat with the air suctioned by the blowing unit 30, and heat of condensation, which is generated while the refrigerant is condensed, is discharged to the air. Consequently, the air suctioned by the blowing unit 30 is heated while passing through the condenser 53.

The forward-rearward separation plate 13 is disposed in front of the cycle chamber 14, and the tank installation space 16 is defined by the forward-rearward separation plate 13.

A tank module 70 is installed in the tank installation space 16. In this embodiment, the forward-rearward separation plate 13 is disposed in front of the inlet duct 34, and a tank installation space 16 is defined by the forward-rearward separation plate 13.

The tank module 70 includes a water supply tank 80 for supplying water to the steam unit 40 and a drainage tank 90 for storing condensed water generated in at least one of the heat pump unit 50 or the treatment chamber 12.

The water supply tank 80 is connected to the stream unit 40 in order to supply water to the stream unit 40, and the drainage tank 90 stores water condensed in the treatment chamber 12 or in the heat pump unit 50.

The controller 60 receives the inlet temperature from the inlet temperature sensor 39. The controller 60 controls the steam unit 40, the blowing unit 30, and the heat pump unit 50 according to user settings or the inlet temperature in order to perform each cycle in which clothes are treated in the clothes treatment apparatus according to a set course.

The controller 60 may operate the blowing unit 30 while the steam unit 40 is preheated. The controller 60 may control the operation of the heat pump unit 50 based on a preheating inlet temperature measured by the inlet temperature sensor 39.

The controller 60 may control the heat pump unit 50 differently depending on the preheating inlet temperature.

In the case in which the preheating inlet temperature is higher than or equal to a predetermined reference inlet temperature, the heat pump unit 50 may be controlled so as to be heated more slowly than in the case in which the preheating inlet temperature is lower than the reference inlet temperature.

That is, in the case in which the preheating inlet temperature is lower than the reference inlet temperature, the controller 60 may drive the compressor 51 at a predetermined first operation speed, and in the case in which the preheating inlet temperature is higher than or equal to the reference inlet temperature, the controller 60 may drive the compressor 51 at a predetermined second operation speed, which is lower than the first operation speed.

The controller 60 may compare a drying inlet temperature measured by the inlet temperature sensor 39 with the preheating inlet temperature in order to control the heat pump unit 50. That is, the controller 60 stops driving the heat pump unit 50 depending on the difference between the drying inlet temperature and the preheating inlet temperature. The drying inlet temperature is the temperature measured by the inlet temperature sensor 39 at the time of drying. The preheating inlet temperature is the temperature measured by the inlet temperature sensor 39 at the time of preheating.

Figures 5A, 5B, 5C:
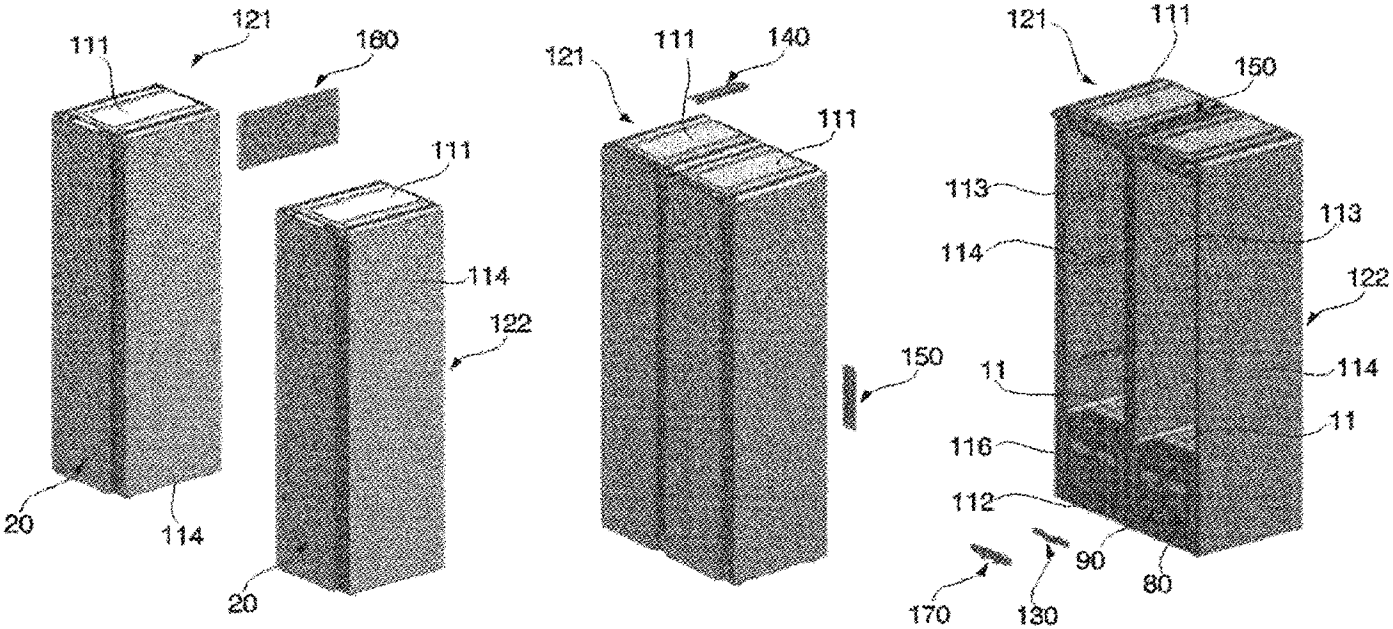
FIGS. 5A to 5C are illustrations showing a union assembly of a clothes treatment apparatus according to a first embodiment of the present invention.
Figure 6:
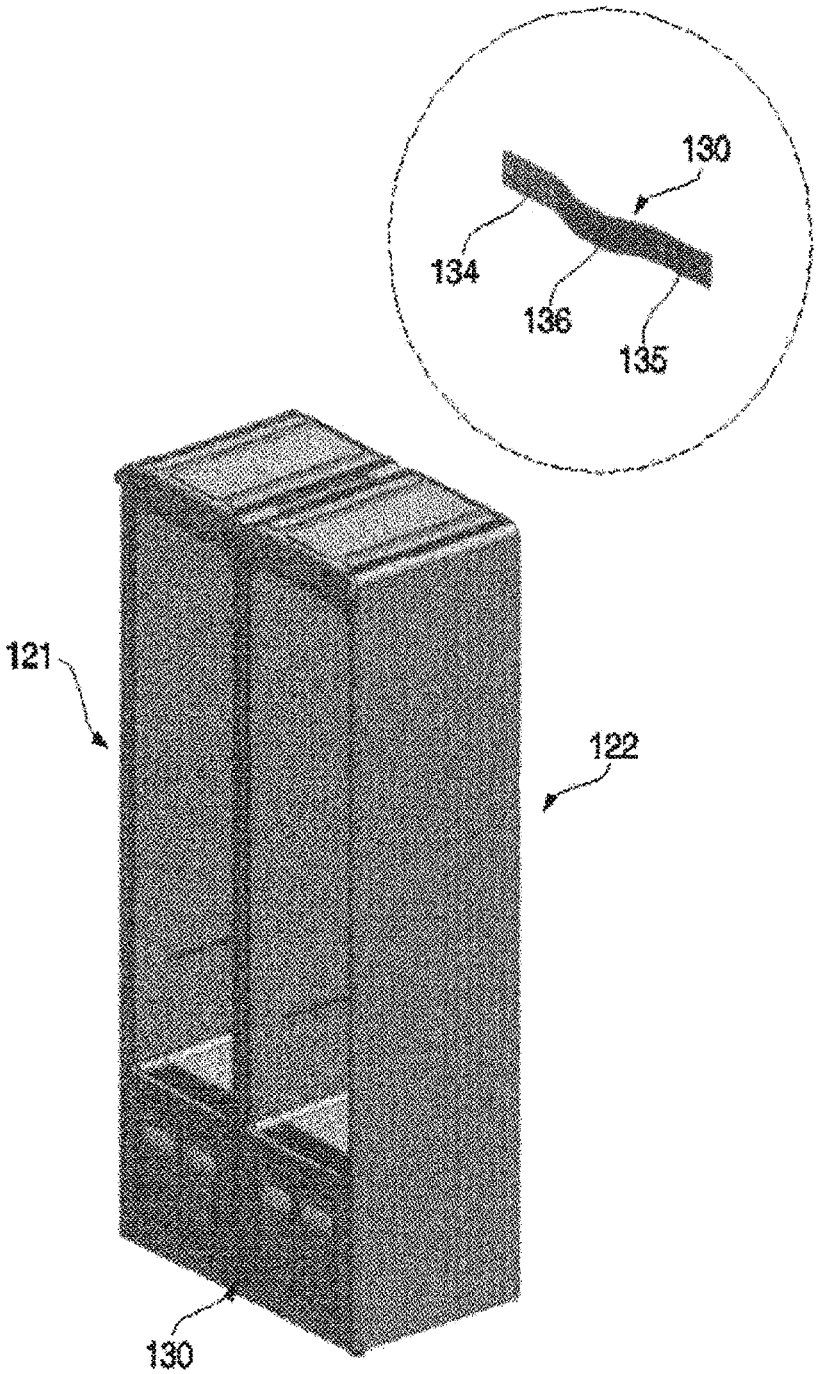
FIG. 6 is a perspective view showing the state in which a width-direction bracket shown in FIGS. 5A to 5C is installed.
Figure 7:
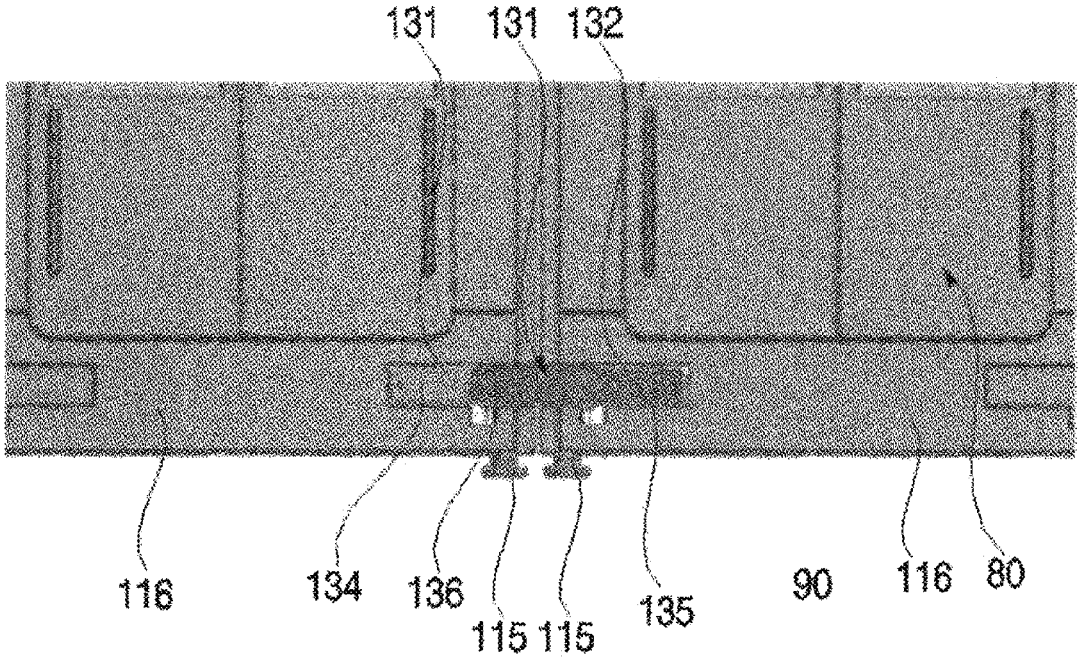
FIG. 7 is a front view showing the state in which the width-direction bracket shown in FIG. 6 is installed.
Figure 8:
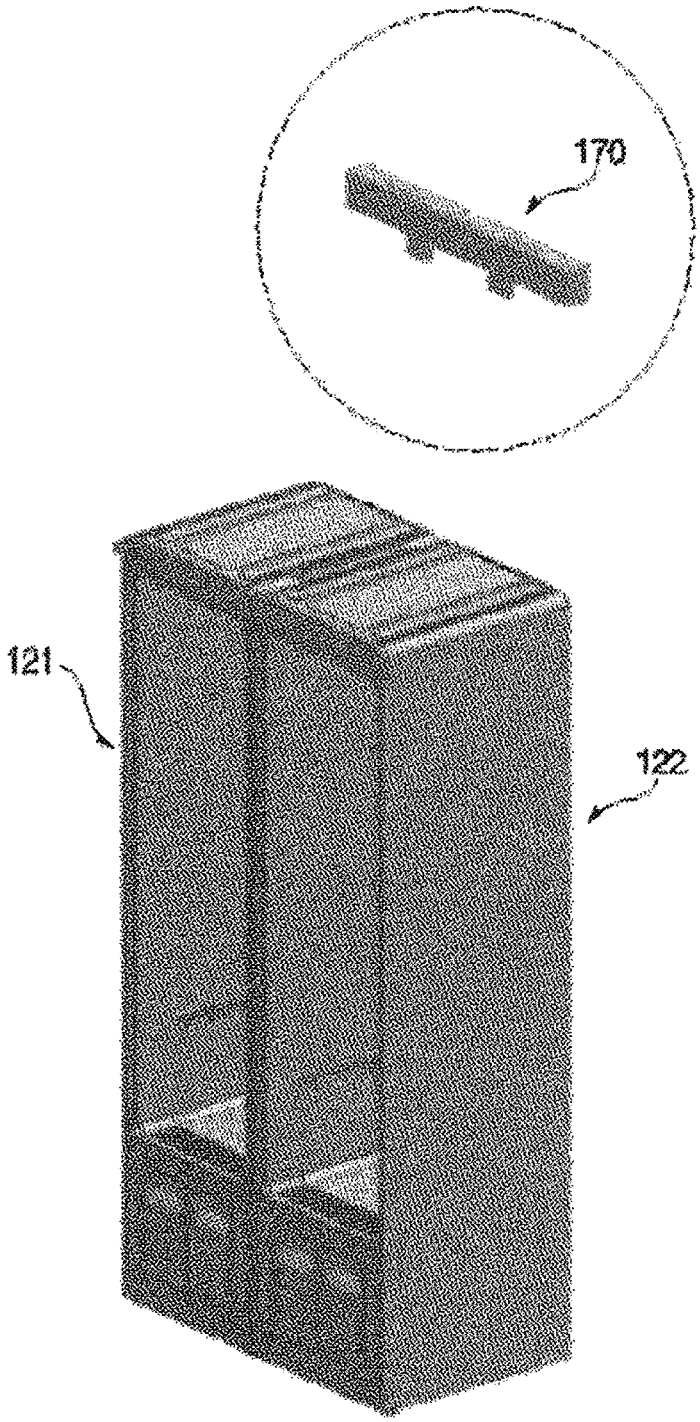
FIG. 8 is a perspective view showing the state in which a bracket cover shown in FIGS. 5A to 5C is installed.
Figure 9:
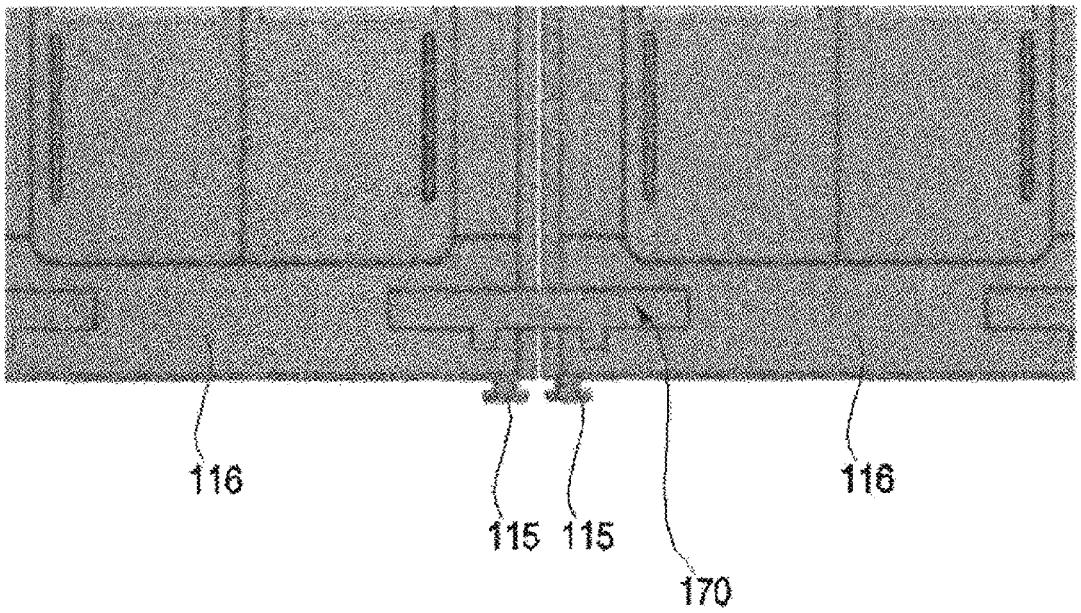
FIG. 9 is a front view showing the state in which the bracket cover shown in FIGS. 5A to 5C is installed.
Figure 10:
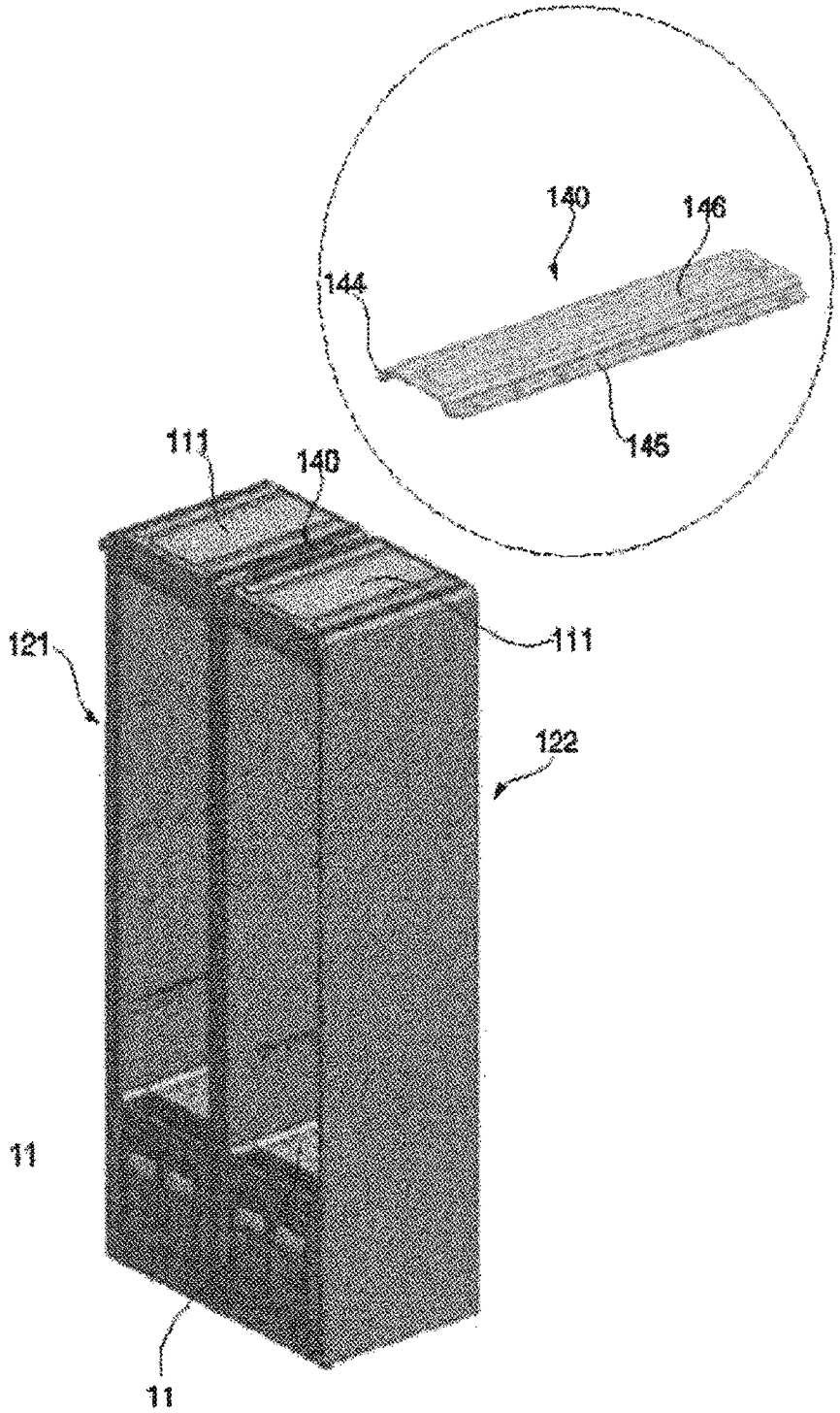
FIG. 10 is a perspective view of a depth-direction bracket shown in FIGS. 5A to 5C.
Figure 11:
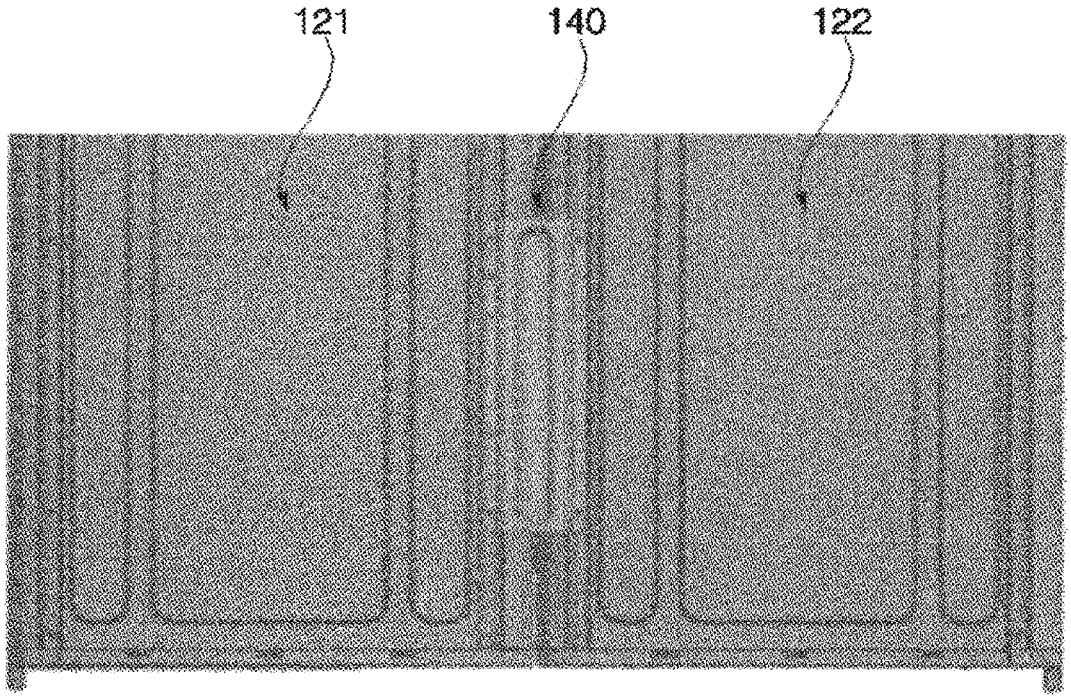
FIG. 11 is a front view showing the state in which the depth-direction bracket shown in FIG. 9 is installed.
Figure 12:
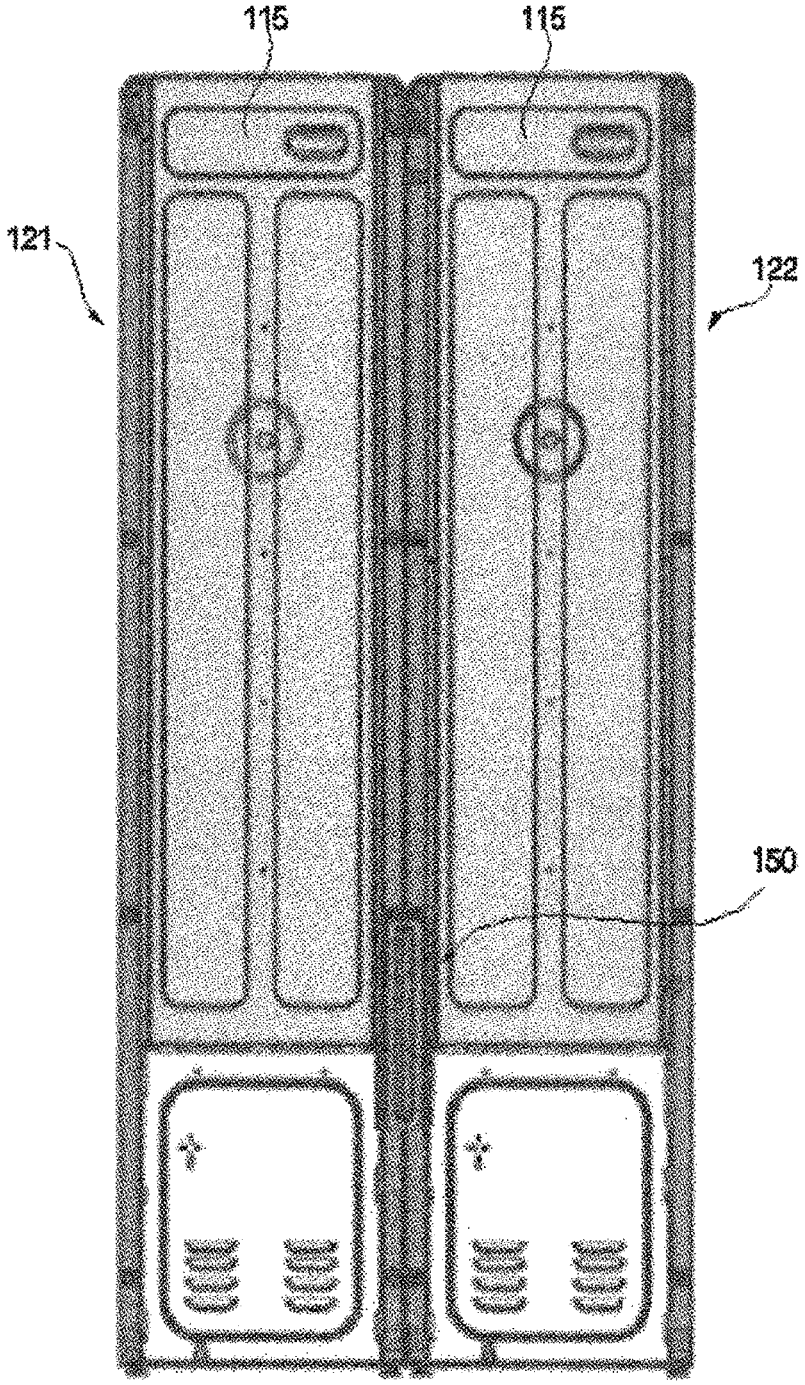
FIG. 12 is a bottom view of a height-direction bracket shown in FIGS. 5A to 5C.

FIGS. 5A to 5C are illustrations showing a union assembly of a clothes treatment apparatus according to a first embodiment of the present invention, FIG. 6 is a perspective view showing the state in which a width-direction bracket shown in FIGS. 5A to 5C is installed, FIG. 7 is a front view showing the state in which the width-direction bracket shown in FIG. 6 is installed, FIG. 8 is a perspective view showing the state in which a bracket cover shown in FIGS. 5A to 5C is installed, FIG. 9 is a front view showing the state in which the bracket cover shown in FIGS. 5A to 5C is installed, FIG. 10 is a perspective view of a depth-direction bracket shown in FIGS. 5A to 5C, FIG. 11 is a front view showing the state in which the depth-direction bracket shown in FIG. 9 is installed, and FIG. 12 is a bottom view of a height-direction bracket shown in FIGS. 5A to 5C.

The case 110 is open at the front thereof. The open front of the case is opened and closed by the door 20.

The case 110 includes an upper wall 111, a lower wall 112, a left wall 113, a right wall 114, a rear wall 115, and a front wall 116. The upward-downward separation plate 11 is connected to the left wall 113, the right wall 114, the rear wall 115, and the front wall 116, and partitions the interior of the case 110 into upper and lower parts.

The front wall 116 is formed by opening the front that defines the treatment chamber 12. The front wall 116 is formed by opening the front that defines the tank installation space 16.

The treatment chamber 12 is defined on the upper side of the upward-downward separation plate 11.

The forward-rearward separation plate 13 is connected to the upward-downward separation plate 11 and the lower wall 112, and partitions the space under the upward-downward separation plate 11 into the cycle chamber 14 and the tank installation space 16. The tank installation space 16 is defined in front of the forward-rearward separation plate 13, and the cycle chamber 14 is defined at the rear of the forward-rearward separation plate 13.

In the first clothes treatment unit 1, which is disposed on the left, the door 20 is disposed so as to be opened to the left. In the second clothes treatment unit 2, which is disposed on the right, the door 20 is disposed so as to be opened to the right.

In the clothes treatment apparatus according to this embodiment, therefore, a user may open the two doors 20 in opposite directions using his/her left and right hands.

In order to couple the first clothes treatment unit 1 and the second clothes treatment unit 2, which are independently constructed, to each other, the clothes treatment apparatus according to this embodiment further includes a union assembly 120.

The union assembly 120 is provided in order to couple the cases 110 of the first clothes treatment unit 1 and the second clothes treatment unit 2 to each other. For the convenience of description, the case of the first clothes treatment unit 1 will be referred to as a first case 121, and the case of the second clothes treatment unit 2 will be referred to as a second case 122.

The union assembly 120 includes a width-direction bracket 130 for coupling the first case 121 and the second case 122 to each other in a width direction, a depth-direction bracket 140 for coupling the first case 121 and the second case 122 to each other in a depth direction, a height-direction bracket 150 for coupling the first case 121 and the second case 122 to each other in a height direction, a gap member 160 interposed between the first case 121 and the second case 122 for spacing the first case 121 and the second case 122 apart from each other by a predetermined distance, and a bracket cover 170 coupled to the first case 121 and the second case 122 for covering the width-direction bracket 130.

The first case 121 and the second case 122 are coupled to each other through the union assembly 120. In the case in which it is necessary to change the position of the clothes treatment apparatus or to move the clothes treatment apparatus, the union assembly 120 may be disassembled, and then the first case 121 and the second case 122 may be moved separately.

In the case in which the clothes treatment apparatus is moved in the state in which the union assembly 120 is coupled thereto, the width-direction bracket 130, the depth-direction bracket 140, or the height-direction bracket 150 may be bent. Particularly, in the case in which a load is concentrated on the union assembly, the cases may be damaged.

The gap member 160 is disposed between the first case 121 and the second case 122. The gap member 160 may compensate for the gap between the first case 121 and the second case 122. In the case in which the first case 121 or the second case 122 is tilted due to an uneven floor, the upper gap between the first case 121 and the second case 122 and the lower gap between the first case 121 and the second case 122 may be different from each other. The gap member 160 may compensate for this.

In addition, the gap member 160 may maximally prevent damage to the first case 121 and the second case 122 caused due to contact therebetween. Since the first clothes treatment unit 1 and the second clothes treatment unit 2 may be separated from each other so as to be used in different spaces, the gap member may prevent the surfaces of the cases 121 and 122 from being scratched when the cases are coupled to each other.

The gap member 160 may be made of an elastic material, and may be manufactured so as to have the form of a sheet having a large surface.

The gap member 160 is disposed at each of the upper and lower sides of the first case 121 and the second case 122.

The gap member 160 may be made of a material that exhibits a high surface friction force, or an adhesive component may be applied to the surface of the gap member 160.

The gap member 160 may be attached to the first case 121 and the second case 122 using the friction force thereof or the adhesive component applied to the surface thereof without using a separate member for positioning the gap member.

The gap member 160 spaces the first case 121 and the second case 122 apart from each other in the width direction. Since the first case 121 and the second case 122 are spaced apart from each other by the gap member 160, the doors 20 are prevented from interfering with each other when the doors are opened and closed.

Since the doors 20 are opened in opposite directions, the doors may interfere with each other when the doors 20 are opened simultaneously in the state in which the doors are in tight contact with each other. The gap member 160 spaces the first case 121 and the second case 122 apart from each other in order to secure the turning radius of each of the doors 20.

The width-direction bracket 130 is fastened to the first case 121 and the second case 122 in the state of being disposed in the width direction. The width-direction bracket 130 is disposed in the leftward-rightward direction.

The width-direction bracket 130 may be disposed on at least one of the front surfaces, the upper surfaces, and the rear surfaces of the first case 121 and the second case 122.

The width-direction bracket 130 may interconnect the front walls 116 of the first case 121 and the second case 122. The width-direction bracket 130 may interconnect the upper walls 111 of the first case 121 and the second case 122. The width-direction bracket 130 may interconnect the rear walls 115 of the first case 121 and the second case 122.

In this embodiment, the width-direction bracket 130 is disposed on the front surfaces of the first case 121 and the second case 122 in order to interconnect the front surfaces thereof.

The first case 121 and the second case 122 are provided with width-direction installation recesses 131 and 132, in which the width-direction bracket 130 is installed. In this embodiment, the width-direction installation recesses 131 and 132 are formed in the lower sides of the front surfaces of the first case 121 and the second case 122.

For the convenience of description, the width-direction installation recess formed in the first case will be referred to as a first width-direction installation recess 131, and the width-direction installation recess formed in the second case will be referred to as a second width-direction installation recess 132.

The width-direction bracket 130 may be disposed on the upper sides of legs 115 for supporting the cases 121 and 122. When external force is applied to the first case 121 or the second case 122, the external force is supported by the legs 115. In the case in which the upper sides of the legs 115 are connected to each other so as to be fixed, the rigidity of the first case 121 and the second case 122 may be effectively improved.

The leg 115 of the first case 121 is disposed on the lower side of the first width-direction installation recess 131, and the leg 115 of the second case 122 is disposed on the lower side of the second width-direction installation recess 132.

The width-direction bracket 130 is inserted into the width-direction installation recesses 131 and 132, and is then fixed using fastening means, such as bolts or screws.

The width-direction bracket 130 includes a first width-direction fixation part 134, which is inserted into the first width-direction installation recess 131 and is fixed to the first case 121, a second width-direction fixation part 135, which is inserted into the second width-direction installation recess 132 and is fixed to the second case 122, and a width-direction connection part 136 for interconnecting the first width-direction fixation part 134 and the second width-direction fixation part 135.

The gap member 160 is disposed at the rear of the width-direction connection part 136.

The first width-direction fixation part 134 may be fixed using at least two fastening members. The second width-direction fixation part 135 may be fixed using at least two fastening members.

The width-direction connection part 136 is formed so as to protrude further forwards than the first width-direction fixation part 134 and the second width-direction fixation part 135. The width-direction connection part 136 is gently curved. Unlike this embodiment, the width-direction connection part 136 may be bent.

The width-direction bracket 130 is disposed on the front surfaces of the first case 121 and the second case 122. When the doors 20 are opened, therefore, the width-direction bracket 130 is exposed to a user. In order to prevent such exposure of the width-direction bracket, the bracket cover 170 is provided.

The bracket cover 170 is inserted into the width-direction installation recesses 131 and 132.

The bracket cover 170 may not be fixed using fastening members. In this embodiment, the bracket cover 170 may be coupled by fitting or catching. The bracket cover 170 covers the width-direction bracket 130.

Since the width-direction bracket 130 is covered by the bracket cover 170, a user cannot recognize the union assembly 120 even when the user looks at the front of the clothes treatment apparatus in the state in which the doors 20 are open. Since the width-direction bracket 130 is covered by the bracket cover 170, the first case 121 and the second case 122 may be recognized as a single case.

In this embodiment, only one width-direction bracket 130 is installed. Unlike this embodiment, a plurality of width-direction brackets 130 may be installed. For example, the width-direction brackets 130 may be installed at the upper and lower sides of the first case 121 and the second case 122.

In this embodiment, the depth-direction bracket 140 is installed instead of installing the width-direction bracket 130 at the upper sides of the cases.

The depth-direction bracket 140 may be installed at the upper walls 111 or the lower walls 112. The depth-direction bracket 140 is disposed in the depth direction of the cases 110. The depth-direction bracket 140 has a length greater than a width.

The depth-direction bracket 140 may interconnect the upper walls 111 of the first case 121 and the second case 122. The depth-direction bracket 140 may interconnect the lower walls 112 of the first case 121 and the second case 122.

In this embodiment, the depth-direction bracket 140 is formed so as to extend in the depth direction of the first case 121 and the second case 122.

The depth-direction bracket 140 includes a first depth-direction fixation part 144, which is fixed to the first case 121, a second depth-direction fixation part 145, which is fixed to the second case 122, and a depth-direction connection part 146 for interconnecting the first depth-direction fixation part 144 and the second depth-direction fixation part 145.

The first depth-direction fixation part 144 is fixed to the upper wall 111 of the first case 121. The second depth-direction fixation part 145 is fixed to the upper wall 111 of the second case 122.

The first depth-direction fixation part 144 may be fixed using at least two fastening members. The second depth-direction fixation part 145 may be fixed using at least two fastening members.

The depth-direction connection part 146 is formed so as to protrude further upwards than the first depth-direction fixation part 144 and the second depth-direction fixation part 145. The depth-direction connection part 146 is gently curved. Unlike this embodiment, the depth-direction connection part 146 may be bent.

The gap member 160 is disposed on the lower side of the depth-direction connection part 146.

The depth-direction bracket 140 may be disposed in the middles of the first case 121 and the second case 122 in the depth direction thereof.

In the case in which the width-direction bracket 130 is disposed at the lower sides of the cases 121 and 122, the depth-direction bracket 140 may be disposed at the upper sides of the cases 121 and 122. In the case in which the width-direction bracket 130 is disposed at the upper sides of the cases 121 and 122, the depth-direction bracket 140 may be disposed at the lower sides of the cases 121 and 122.

The width-direction bracket 130 and the depth-direction bracket 140 may be disposed at opposite sides of the first case 121 and the second case 122.

The height-direction bracket 150 may be installed at the rear walls 115 or at at least one of the front walls 116. In this embodiment, the height-direction bracket 150 is installed at the rear walls 115. The height-direction bracket 150 is identical in shape and construction to the depth-direction bracket 140, and therefore a detailed description thereof will be omitted.

The height-direction bracket 150 may be disposed in the middles of the first case 121 and the second case 122 in the height direction thereof. The height-direction bracket 150 may be disposed between the depth-direction bracket 140 and the width-direction bracket 130 in the height direction of the cases.

In this embodiment, the height-direction bracket 150 is disposed at the rear of the upward-downward separation plate 11. A portion of the height-direction bracket 150 is located at the rear of the treatment chamber 12, and the remaining portion of the height-direction bracket 150 is located at the rear of the cycle chamber 14.

The height-direction bracket 150 may maximally prevent the generation of vibration from the cycle chamber 14.

The union assembly 120 according to this embodiment may be installed at the cases 121 and 122 in the depth direction, the width direction, and the height direction thereof in order to securely couple the cases 121 and 122 to each other and maximally prevent the generation of vibration during the operation of the clothes treatment apparatus.

When the compressor 51 and the blowing fan module 32 in the cycle chamber 14 or the moving hanger 100 in the treatment chamber 12 is operated, vibration may be generated.

In particular, when one of the first clothes treatment unit 1 and the second clothes treatment unit 2 is operated, vibration generated from the clothes treatment unit that is operated may be transmitted to the other clothes treatment unit, which is not operated, whereby operation noise may be generated.

The union assembly 120 fixes the cases 121 and 122 in the depth direction, the width direction, and the height direction thereof, thereby preventing vibration generated from one of the clothes treatment units from being transmitted to the other clothes treatment unit.

In addition, when both the first clothes treatment unit 1 and the second clothes treatment unit 2 are operated, resonance may occur. Since the clothes treatment units 1 and 2 are fixed in the depth direction, the width direction, and the height direction thereof, the overall rigidity of the clothes treatment units may be increased.

In this embodiment, only the width-direction bracket 130 has been described as being installed in the installation recesses. Alternatively, the depth-direction bracket 140 or the height-direction bracket 150 may also be installed in installation recesses.

Also, in this embodiment, only the width-direction bracket 130 has been described as being covered by the bracket cover 170. Alternatively, the depth-direction bracket 140 or the height-direction bracket 150 may also be covered by a bracket cover (not shown).

Figure 13:
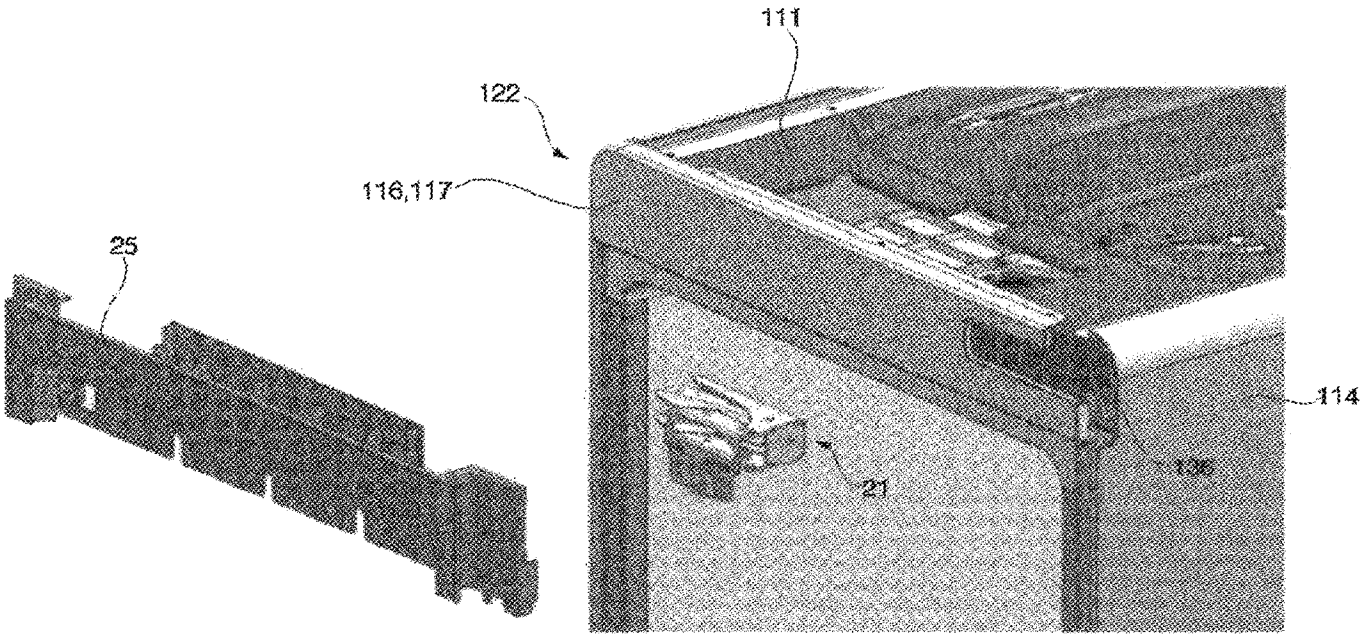
FIG. 13 is an exploded perspective view of an upper door hinge shown in FIGS. 5A to 5C.
Figure 14:
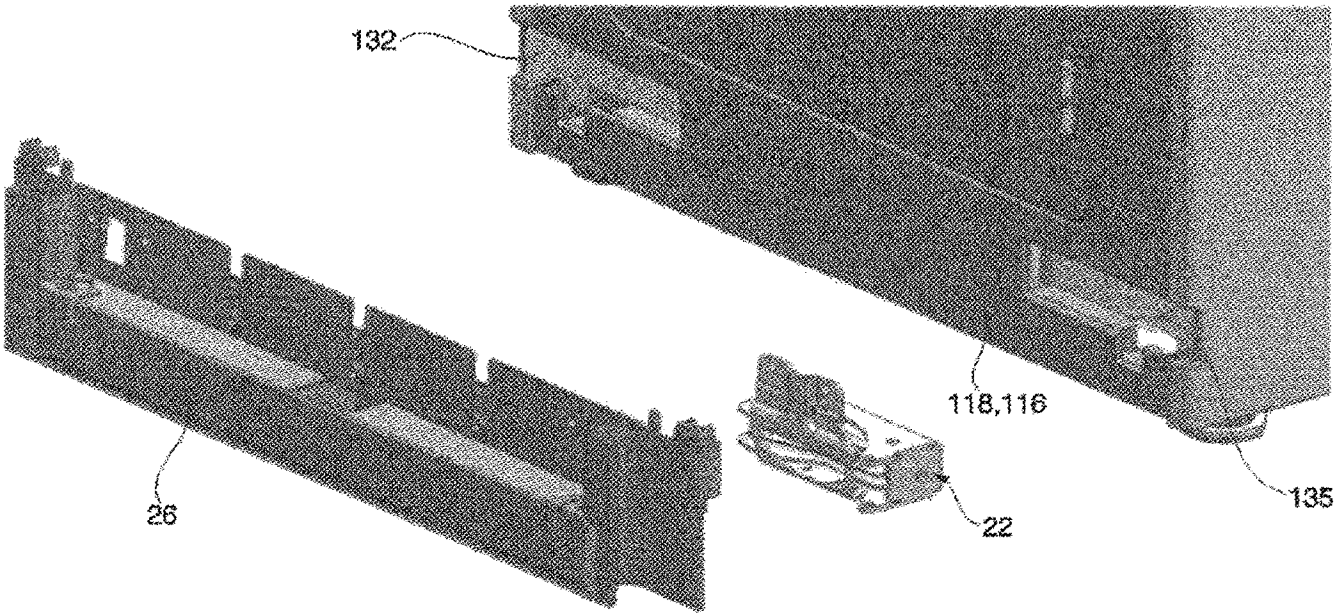
FIG. 14 is an exploded perspective view of a lower door hinge shown in FIGS. 5A to 5C.

FIG. 13 is an exploded perspective view of an upper door hinge shown in FIGS. 5A to 5C, and FIG. 14 is an exploded perspective view of a lower door hinge shown in FIGS. 5A to 5C.

Referring to the figures, a portion of the front wall 116 of each of the first case 121 and the second case 122 includes an upper decoration frame 117 and a lower decoration frame 118.

The upper decoration frame of the first case 121 will be referred to as a first upper decoration frame, and the lower decoration frame of the first case 121 will be referred to as a first lower decoration frame.

The upper decoration frame of the second case 122 will be referred to as a second upper decoration frame, and the lower decoration frame of the second case 122 will be referred to as a second lower decoration frame.

The first lower decoration frame and the second lower decoration frame are identical in structure to each other.

The upper decoration frame 117 is provided with a hinge installation recess 136, into which an upper door hinge 21 of a corresponding one of the doors 20 is inserted. The lower decoration frame 118 is provided with a hinge installation recess 137, into which a lower door hinge 22 of a corresponding one of the doors 20 is inserted, and with the width-direction installation recess 132.

The hinge installation recess 137 and the width-direction installation recess 132 are identical in shape to each other, and are disposed symmetrically in the vertical direction.

In the case in which the direction in which each of the doors 20 is opened is changed, the width-direction bracket 130 may be installed in the hinge installation recess 137, and the lower door hinge 22 may be installed in the width-direction installation recess 132.

The terms "width-direction installation recess" and "hinge installation recess" are functional terms. In the case in which the structural body installed in the width-direction installation recess is the lower door hinge 22, the term "hinge installation recess" is used. In the case in which the structural body installed in the width-direction installation recess is the width-direction bracket 130, the term "width-direction installation recess" is used. The width-direction installation recess and the hinge installation recess are identical in structure to each other and are disposed in a symmetrical arrangement.

The direction in which each of the doors 20 is opened may be changed as needed. In the case in which the direction in which each of the doors 20 is opened is changed, it is necessary to replace the upper decoration frame 117, which corresponds to the upper door hinge 21. The reason for this is that the upper door hinge 21 is installed on only the left side or the right side.

An upper door decoration member 25, which is fastened to the upper door hinge 21, is disposed at the upper side of the rear surface of each of the doors 20. An upper door decoration member 26, which is fastened to the lower door hinge 22, is disposed at the lower side of the rear surface of each of the doors 20.

It will be apparent that, although the preferred embodiments have been shown and described above, the present invention is not limited to the above-described specific embodiments, and various modifications and variations can be made by those skilled in the art without departing from the gist of the appended claims. Thus, it is intended that the modifications and variations should not be understood independently of the technical spirit or prospect of the present invention.

DESCRIPTION OF REFERENCE NUMERALS

| | |
|---|---|
| 110: | Case |
| 11: | Upward-downward separation plate |
| 12: | Treatment chamber |
| 13: | Forward-rearward separation plate |
| 14: | Cycle chamber |
| 20: | Door |
| 30: | Blowing unit |
| 39: | Inlet temperature sensor |
| 40: | Steam unit |
| 50: | Heat pump unit |
| 70: | Tank module |
| 80: | Water supply tank |
| 90: | Drainage tank |
| 100: | Moving hanger |
| 120: | Union assembly |
| 121: | First case |
| 122: | Second case |
| 130: | Width-direction bracket |
| 140: | Depth-direction bracket |
| 150: | Height-direction bracket |
| 160: | Gap member |
| 170: | Bracket cover |

What is claimed is:

1. A clothes treatment apparatus comprising:

a first case that defines a first opening at a first front side of the clothes treatment apparatus;

a first treatment chamber that is disposed inside of the first case and that is configured to receive clothes;

a first cycle chamber that is disposed below the first treatment chamber and that is located inside of the first case;

a second case that defines a second opening at a second front side of the clothes treatment apparatus and that is disposed adjacent to the first case;

a second treatment chamber that is disposed inside of the second case and that is configured to receive clothes;

a second cycle chamber that is disposed below the second treatment chamber and that is located inside of the second case;

first lower installation recesses including a first lower-left installation recess and a first lower-right installation recess that are disposed at a lower-left side and a lower-right side of the first front side, respectively, and that extend along a width direction of the first case;

second lower installation recesses including a second lower-left installation recess and a second lower-right installation recess that are disposed at a lower-left side and a lower-right side of the second front side, respectively, and that extend along a width direction of the second case; and a width-direction bracket inserted into a first recess of the first lower installation recesses and a first recess of the second lower installation recesses, wherein a distance between the first recess of the second lower installation recesses and the first recess of the first lower installation recesses is shorter than a distance between a second recess of the first lower installation recesses and the first recess of the first lower installation recesses, based on an arrangement of the first case and the second case.

2. The clothes treatment apparatus according to claim 1, further comprising:

a first door that is rotatably connected to the first case and that is configured open and close the first opening with a first door hinge part; and a second door that is rotatably connected to the second case and that is configured to open and close the second opening with a second door hinge part, wherein the first door hinge part includes a first lower door hinge disposed at a lower side of the first door, wherein the second door hinge part includes a second lower door hinge disposed at a lower side of the second door, and wherein each of the first lower door hinge and the second lower door hinge is installed in each corresponding door and inserted into the second recess of the first lower installation recesses and a second recess of the second lower installation recesses, respectively.

3. The clothes treatment apparatus according to claim 2, further comprising:

a first upper installation recess that is disposed at one of an upper-left side or an upper-right side of the first front side and that extends along the width direction of the first case; and a second upper installation recess that is disposed at one of an upper-left side or an upper-right side of the second front side and that extends along the width direction of the second case, wherein the first door hinge part further includes a first upper door hinge that is disposed above the first lower door hinge and that is inserted into the first upper installation recess, and wherein the second door hinge part includes a second upper door hinge that is disposed above the second lower door hinge and that is inserted into the second upper installation recess.

4. The clothes treatment apparatus according to claim 3, wherein the width-direction bracket is inserted into the first lower-left installation recess and the second lower-right installation recess based on the second case being disposed at a left side of the first case, wherein the first upper installation recess is disposed at the upper-right side of the first front side, and the second upper installation recess is disposed at the upper-left side of the second front side, and wherein the first lower door hinge is inserted into the first lower-right installation recess, and the second lower door hinge is inserted into the second lower-left installation recess.

5. The clothes treatment apparatus according to claim 3, wherein the width-direction bracket is inserted into the first lower-right installation recess and the second lower-left installation recess based on the second case being disposed at a right side of the first case, wherein the first upper installation recess is disposed at the upper-left side of the first front side, and the second upper installation recess is disposed at the upper-right side of the second front side, and wherein the first lower door hinge is inserted into the first lower-left installation recess, and the second lower door hinge is inserted into the second lower-right installation recess.

6. The clothes treatment apparatus according to claim 3, wherein the first lower-left installation recess and the first lower-right installation recess are (i) identical in shape to each other and (ii) disposed symmetrically in a height direction of the first case, wherein the first upper installation recess is identical in shape to one of the first lower-left installation recess or the first lower-right installation recess, based on a location of the first upper installation recess, wherein the second lower-left installation recess and the second lower-right installation recess are (i) identical in shape to each other and (ii) disposed symmetrically in a height direction of the second case, and wherein the second upper installation recess is identical in shape to one of the second lower-left installation recess or the second lower-right installation recess, based on a location of the second upper installation recess.

7. The clothes treatment apparatus according to claim 6, wherein the first lower-left installation recess and the second lower-left installation recess are identical in shape.

8. The clothes treatment apparatus according to claim 1, wherein the width-direction bracket includes:

a first width-direction fixation part that is inserted into one of the first lower-left installation recess or the first lower-right installation recess and that is fixed to the first case;

a second width-direction fixation part that is inserted into one of the second lower-right installation recess or the second lower-left installation recess, based on an inserted location of the first width-direction fixation part and that is fixed to the second case; and a width-direction connection part connecting the first width-direction fixation part to the second width-direction fixation part.

9. The clothes treatment apparatus according to claim 8, wherein a shape of the first width-direction fixation part and a shape of the second width-direction fixation part are symmetrical to each other.

10. The clothes treatment apparatus according to claim 9, wherein the first width-direction fixation part and the second width-direction fixation part are bent from each end of the width-direction fixation part and extended in parallel to the width-direction fixation part.

11. The clothes treatment apparatus according to claim 1, further comprising:

a depth-direction bracket configured to couple at least one of upper sides or lower sides of the first case and the second case to each other in a depth direction of the clothes treatment apparatus; and a height-direction bracket configured to couple at least one of the front sides or rear sides of the first case and the second case to each other in a height direction of the clothes treatment apparatus.

12. The clothes treatment apparatus according to claim 11, further comprising:

a gap member disposed between the first case and the second case for spacing the first case and the second case apart from each other by a predetermined distance.

13. The clothes treatment apparatus according to claim 1, further comprising:

a bracket cover that is coupled to (i) the first lower-left installation recess and the second lower-right installation recess or the (ii) first lower-right installation recess and the second lower-left installation recess, based on a position of the width-direction bracket and that is configured to cover the width-direction bracket.

14. The clothes treatment apparatus according to claim 1, further comprising:

a first lower decoration frame disposed at a lower first front side; and a second lower decoration frame disposed at a lower second front side, wherein the first lower installation recesses are provided in the first lower decoration frame, and the second lower installation recesses are provided in the second lower decoration frame.

15. The clothes treatment apparatus according to claim 1, wherein the first lower installation recesses are disposed below the first cycle chamber, and the second lower installation recesses are disposed below the second cycle chamber.

16. The clothes treatment apparatus according to claim 3, further comprising:

a first upper decoration frame disposed at an upper first front side; and a second upper decoration frame disposed at an upper second front side, wherein the first upper installation recess is provided in the first upper decoration frame, and the second upper installation recess is provided in the second upper decoration frame.

17. The clothes treatment apparatus according to claim 1, comprising:

a union assembly including the width-direction bracket and configured to fix at least two surfaces of the first case and the second case.

18. The clothes treatment apparatus according to claim 17, wherein the union assembly further comprises:

a depth-direction bracket for coupling the first case and the second case to each other in a depth direction; and a height-direction bracket for coupling the first case and the second case to each other in a height direction, and wherein at least two of the width-direction bracket, the depth-direction bracket, or the height-direction bracket fix the at least two surfaces of the first case and the second case.

19. The clothes treatment apparatus according to claim 18, wherein the first case further comprises an upper wall, a lower wall, a left wall, a right wall, a rear wall, and a front wall, wherein the second case further comprises an upper wall, a lower wall, a left wall, a right wall, a rear wall, and a front wall, and wherein the width-direction bracket is configured to couple at least one of the front walls or the rear walls of the first case and the second case to each other in a width direction.

20. The clothes treatment apparatus according to claim 19, wherein the depth-direction bracket is configured to couple the upper walls to each other, and the height-direction bracket is configured to couple the rear walls to each other.

* * * * *